US010319543B2

(12) United States Patent
Muders

(10) Patent No.: US 10,319,543 B2
(45) Date of Patent: Jun. 11, 2019

(54) INSTALLATION SWITCHING APPARATUS HAVING AN EXHAUST AIR DUCT AND A SET SCREW

(71) Applicant: ABB Schweiz AG, Baden (CH)

(72) Inventor: Erwin Muders, Heidelberg (DE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/881,825

(22) Filed: Jan. 29, 2018

(65) Prior Publication Data

US 2018/0218860 A1 Aug. 2, 2018

(30) Foreign Application Priority Data

Jan. 30, 2017 (DE) ..... 10 2017 101 728

(51) Int. Cl.

| | |
|---|---|
| ***H01H 33/53*** | (2006.01) |
| ***H01H 71/02*** | (2006.01) |
| ***H01H 71/74*** | (2006.01) |
| ***H01H 9/34*** | (2006.01) |

(52) U.S. Cl.

CPC ..... *H01H 33/53* (2013.01); *H01H 71/025* (2013.01); *H01H 71/7436* (2013.01); *H01H 9/342* (2013.01)

(58) Field of Classification Search

CPC ..... H01H 1/504; H01H 9/342; H01H 9/345; H01H 71/08; H01H 71/10; H01H 71/1081; H01H 73/18; H01H 9/30

USPC ..... 218/155; 200/249

See application file for complete search history.

(56) References Cited

U.S. PATENT DOCUMENTS

| | | | | |
|---|---|---|---|---|
| 2,624,815 A * | 1/1953 | Gano | H01H 71/524 | 218/149 |
| 3,631,369 A * | 12/1971 | Menocal | B60S 3/04 | 337/110 |
| 4,325,041 A * | 4/1982 | Murai | H01H 71/04 | 335/35 |
| 4,546,336 A * | 10/1985 | Petrie | H01H 73/18 | 335/16 |
| 4,780,579 A * | 10/1988 | Asahi | H01H 9/342 | 218/1 |
| 8,735,759 B2 * | 5/2014 | Potratz | H01H 9/342 | 218/155 |

(Continued)

FOREIGN PATENT DOCUMENTS

WO WO 9520237 A1 7/1995

*Primary Examiner* — Edwin A. Leon
*Assistant Examiner* — William A Bolton
(74) *Attorney, Agent, or Firm* — Leydig, Voit & Mayer, Ltd.

(57) ABSTRACT

An installation switching apparatus includes: a housing; at least one contact point; an exhaust air duct which in an upstream portion thereof receives arc gases of a switching arc that has been created at the at least one contact point, and by way of an exhaust air opening in a housing wall of the housing in a downstream portion of the exhaust air duct the exhaust air duct releases the arc gases into an environment of the housing; at least one thermal release; and a set screw for setting the at least one thermal release. The set screw at an activation end thereof has a formed element for contacting in a form-fitting manner a tool for rotating activation of the set screw. An operative end of the set screw is coupled to the at least one thermal release.

5 Claims, 4 Drawing Sheets

(56) References Cited

U.S. PATENT DOCUMENTS

2010/0025378 A1* 2/2010 Yang ..... H01H 9/342
218/155

* cited by examiner

INSTALLATION SWITCHING APPARATUS HAVING AN EXHAUST AIR DUCT AND A SET SCREW

CROSS-REFERENCE TO PRIOR APPLICATION

Priority is claimed to German Patent Application No. DE 10 2017 101 728.3, filed on Jan. 30, 2017, the entire disclosure of which is hereby incorporated by reference herein.

FIELD

The invention proceeds from an installation switching apparatus having a housing and having at least one contact point, and having an exhaust air duct which in the upstream portion thereof receives arc gases of a switching arc that has been created at the contact point, and by way of an exhaust air opening in the housing wall in the downstream portion of said exhaust air duct releases said arc gases into the environment of the housing, and at least one thermal release, and having a set screw for setting said thermal release, wherein the set screw at the activation end thereof has a formed element for contacting in a form-fitting manner a tool for the rotating activation of the set screw, and at the operative end of said set screw is coupled to the thermal release.

BACKGROUND

An installation switching apparatus is, for example, a circuit breaker. Such an installation switching apparatus is in particular a circuit breaker of the type which has an arc control device in which a switching arc that is created in the case of an isolation of the contact point under load or overload, or in the case of a short circuit, enters and therein is quenched. The arc gases herein are directed through the arc control device to the end of the latter at the exhaust air side, and therein are supplied to the upstream portion of an exhaust air duct within the circuit breaker.

Circuit breakers are usually used for interrupting an electrical current path that is routed between a source of electrical energy and an electrical load, so as to react to a defect that has arisen. Circuit breakers are often disposed beside one another in an installation distributor and attached to one or a plurality of bus bars. The contact point of a circuit breaker usually comprises at least one stationary contact piece and one movable contact piece. The circuit breaker opens the contact point in the case of a defect, for example in the case of a short circuit. A switching arc is created between the diverging contact pieces. Said arc is routed by way of arc guide rails to an arc control device. The latter is in most instances formed as a stack of sheet-metal quenching plates having a number of ferromagnetic plates that are stacked on top of one another at a parallel spacing, wherein the arc enters the stack of sheet-metal quenching plates at an entry side, is split into a line of part-arcs that in electrical terms are switched in series, such that the arc impedance is multiplied, the arc being quenched still within the pack of sheet-metal quenching plates. The arc gases accompanying the arc are ionized and thus electrically conductive. The positive pressure prevailing on the arc urges the arc gases through the arc control device, said gases exiting the sheet-metal quenching pack at the exhaust air side of the latter. Said arc gases, due to the electrical conductivity thereof, should exit the interior of the apparatus but not in the region of the bus bars, so as to prevent short circuits between the bus bars. It has therefore been proposed to configure an exhaust air duct in the interior of the apparatus, which in an upstream portion of said exhaust air duct receives the arc gases and in the downstream portion of said exhaust air duct releases said arc gases to the environment of the housing by way of an exhaust air opening in the housing wall. The exhaust air opening is attached to such a location of the housing that outflowing arc gases cannot make their way into the region of the bus bars.

Furthermore, a circuit breaker usually has a thermal over-current release which is formed by way of a strip of a thermostatic bimetal which bends in the case of an enduring over-current and, on account thereof, likewise causes an opening of the contact point. A set screw is usually provided for the thermal adjustment of the bimetal strip. Said set screw is in most instances formed as a cylinder screw. Such a solution is illustrated in WO 95/20237, for example. In order for the set screw to be adjusted, said set screw has to be accessible to an activation tool, for example a screw driver, from the outside of the housing. The position of the screw, once adjusted, should not be changed any more. Therefore, the opening leading to the set screw is usually closed once adjusted. Therefore a further opening in the housing of the circuit breaker is to be provided as the access opening to the set screw, and the closing of the opening upon adjustment is performed in an additional assembly step by adhesively bonding the opening or by adhesively bonding a cover part thereto. This is complex.

SUMMARY

In an embodiment, the present invention provides an installation switching apparatus comprising: a housing; at least one contact point; an exhaust air duct which in an upstream portion thereof is configured to receive arc gases of a switching arc that has been created at the at least one contact point, and by way of an exhaust air opening in a housing wall of the housing in a downstream portion of the exhaust air duct the exhaust air duct is configured to release the arc gases into an environment of the housing; at least one thermal release; and a set screw configured to set the at least one thermal release, wherein the set screw at an activation end thereof has a formed element configured to contact in a form-fitting manner a tool configured for the rotating activation of the set screw, wherein an operative end of the set screw is coupled to the at least one thermal release, and wherein the activation end of the set screw is located in the downstream portion of the exhaust air duct and is accessible through the exhaust air opening for activation by the tool.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

According to the invention, the activation end of the set screw is thus located in the downstream portion of the exhaust air duct and for the activation by means of the tool is accessible through the exhaust air opening.

According to one advantageous embodiment, the counter thread on the housing side for the set screw is located in a housing moulding on the housing internal side.

According to one advantageous embodiment, the housing has a closure duct that is located downstream of the activation end, a screw cover part being displaceably attached in said closure duct, wherein the screw cover part in the closure duct under the effect of an activation force is configured so as to be displaceable in front of the activation end of the set screw in order for the latter to be covered.

Figure 1:
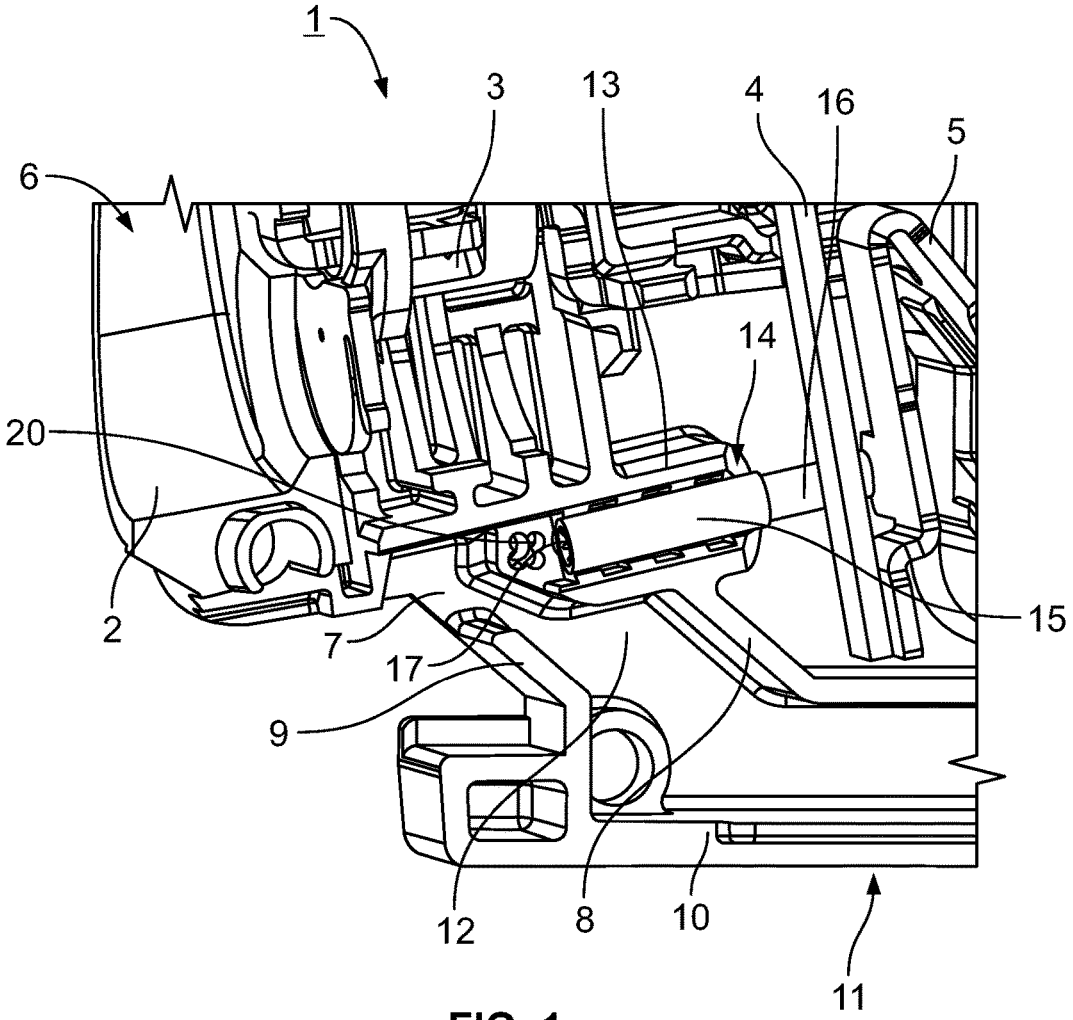
FIG. 1 shows an insight into the opened lower part of a circuit breaker according to an embodiment of the invention, in the region of the downstream portion of the exhaust air duct.
Figure 2:
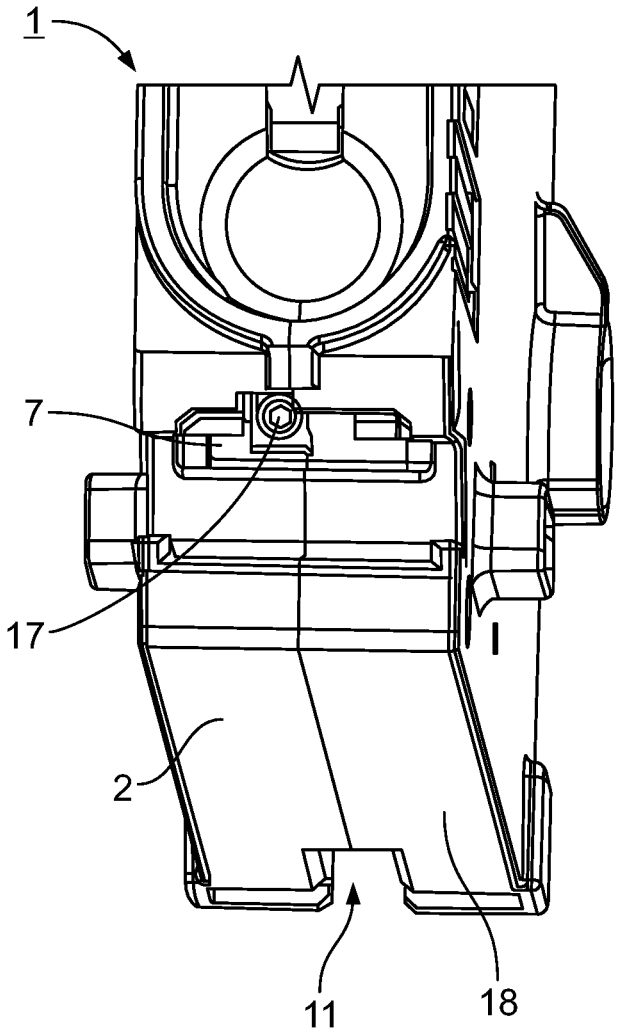
FIG. 2 shows a view onto the housing narrow side of a circuit breaker according to an embodiment of the invention, in the region of the downstream portion of the exhaust air duct, having an accessible set screw.

FIG. 1 shows an insight into the opened lower part 2 of a circuit breaker 1 according to an embodiment of the invention, in the region of the downstream portion of the exhaust air duct. The circuit breaker 1 has a housing in a so-called shell construction. The housing herein is formed by two housing half-shells which are joined at a common encircling edge and are interconnected by means of connection elements. The functional groups and components of the circuit breaker are incorporated in the one housing half-shell, also referred to as the lower part 2. Said functional groups and components comprise the terminal connections 3, the thermal release 4, the switching unit (not visible in the figures), the contact lever having the movable contact piece (not visible in the figures), the stationary contact piece (not visible in the figures), the electromagnetic short circuit release (not visible in the figures), the arc control device (not visible in the figures), and the arc guide rails (of which only a portion of the lower arc guide rail 5 is illustrated in the apparatus fragment illustrated in FIG. 1), and the guide rails, conductor pieces and wires that are required for completing the current path, and optionally further functional groups and elements. Various webs and further contour elements which are required for holding the functional groups and elements mentioned are moulded on the internal side of the lower part 2. In particular, wall elements which conjointly with wall elements that are moulded in a suitable reciprocal location on the internal side of the second housing half-shell, also referred to as the lid, are moulded on the internal side of the lower part 2, said wall elements forming an exhaust air duct which guides the arc gases from the exhaust air side of the arc control device so as to bypass the electromagnetic short circuit release and the thermal release to an exhaust air opening 7 that is located on a narrow side 6 of the housing. A downstream part of such a wall element 8 can be seen in FIG. 1, said wall element 8 conjointly with a wall piece 9 in the region of the narrow side 6 and conjointly with a wall piece 10 in the region of the fastening side 11 of the housing forming the downstream portion 12 of the exhaust air duct.

A moulding 13 that is configured so as to be essentially cuboidal is located on the internal side of the housing wall of the lower part 2 in the downstream portion 12 of the exhaust air duct. Since the lower part is formed from plastics, in particular is produced from a thermoplastic material in an injection-moulding process, the moulding 13 is composed of the same material, thus of plastics, in particular a thermoplastic material. The lid 18 is also composed of plastics, in particular of a thermoplastic material. The lid 18 for the final assembly of the circuit breaker 1 is placed onto the lower part 2. Further webs that protrude into the interior of the housing, and contour elements which cooperate with the webs and contour elements in the lower part of the housing so as to hold the construction elements and components in the respective operating positions thereof and so as to form the exhaust air duct are located on the internal side of the lid 18.

There is a set screw 14 for the thermal adjustment of the thermal release 4. Said set screw 14 here is configured as a grub screw having a threaded portion 15 and a threadless pin portion 16. The pin portion presses against the bimetal strip of the thermal release 4. The counter thread matching the thread 15 of the set screw 14 is located in the moulding 13. To this end, a threadless opening having an internal diameter which is only slightly larger than the diameter of the set screw 14 at the bottom of the screw thread 15 is present in the original state of the moulding 13. The set screw 14 at the activation end thereof has a formed element 17 for contacting in a form-fitting manner a tool for the rotatory activation of the screw. The formed element 17 here is configured as a Torx contour for receiving a Torx screwdriver. The location of the moulding 13 in the downstream portion 12 of the exhaust air duct enables the screwdriver for rotating the set screw 14, and also the set screw 14 per se, to be offered through the exhaust air opening 7. The thread 15 of the set screw in the initial insertion into the threadless opening and in the subsequent driving-in with the aid of the screwdriver cuts its own counter thread in the moulding 13.

Figure 3:
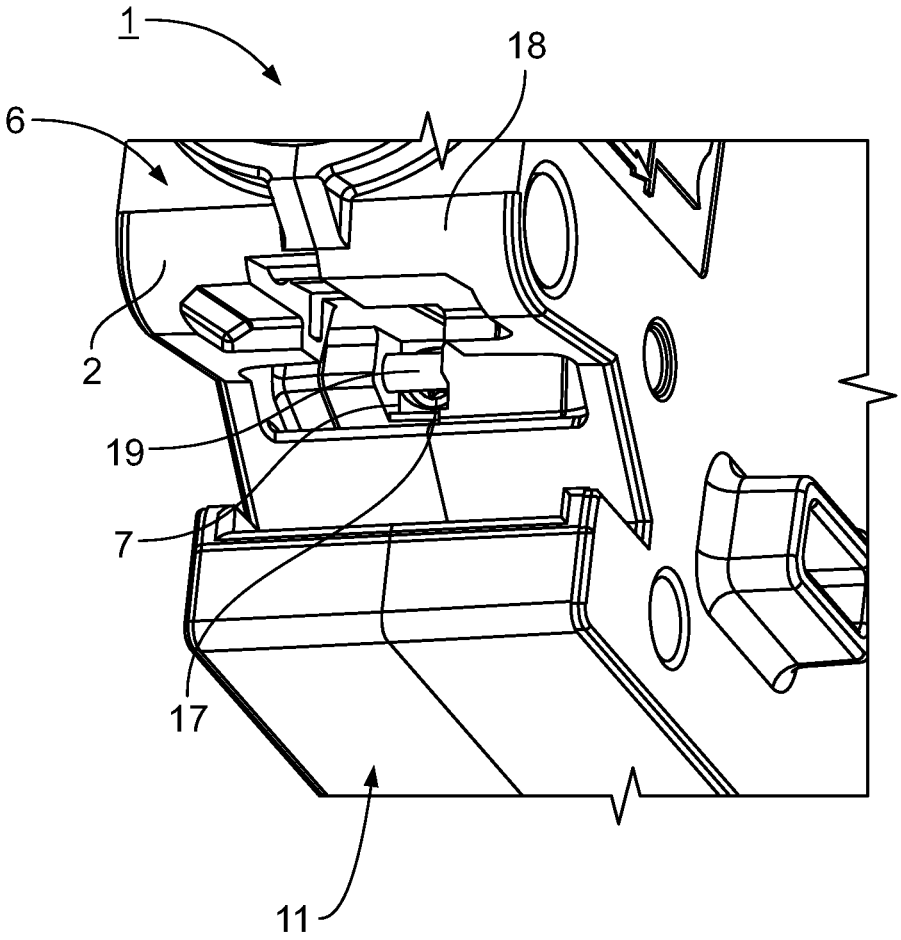
FIG. 3 shows a view onto the housing narrow side of a circuit breaker according to an embodiment of the invention, in the region of the downstream portion of the exhaust air duct, having a covered set screw.

When the thermal release is adjusted, the set screw 14 in a manner corresponding to the rotation thereof is moved toward the bimetal strip of the thermal release or away from the latter, depending on the direction of rotation, the bimetal strip of the thermal release 4 on account thereof being bent to a greater or lesser extent. The set screw is not to be rotated any more once the desired calibrated setting of the thermal release has been reached. The thread 15 of the set screw 14 in the interaction with the counter thread in the moulding 13 has sufficient self-locking. However, it is also to be prevented that the set screw 14, having been adjusted, is again inadvertently or erroneously rotated by a tool by way of the exhaust air opening 7 and is thus again readjusted. For this purpose, a pin 19 is slid in front of the formed element 17 of the set screw 14 upon adjusting, as can be seen in FIG. 3. The pin 19 blocks the access of a tool to the set screw 14 by way of the exhaust air opening 14, and simultaneously permits arc gas to continue flowing out of the exhaust air opening 7. The pin 19 is an exemplary embodiment of an element that is generally to be referred to as a closure element. The latter here is illustrated as a round pin 19. The pin 19 at one end has a pin head, and at the opposite, second end has a rounded feature. Said pin 19 can be slid in front of the set screw with the second, rounded end leading. To this end, a respective force is applied to the pin head at the first end of said pin 19.

In an alternative embodiment (not illustrated in the figures here), the closure element could as be embodied as, for example, a plate or a pin with a different contour, or the like.

Figure 4:
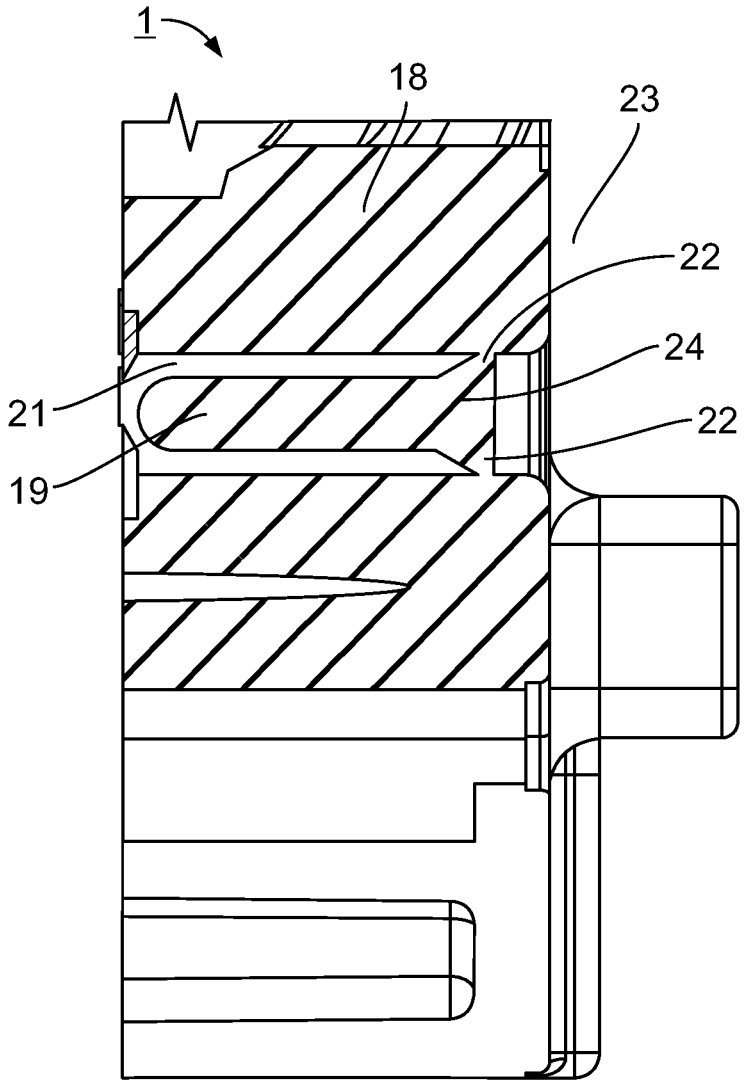
FIG. 4 shows a cross section through the housing lid of a circuit breaker according to an embodiment of the invention, having a closure part moulded therein.

As is shown in FIG. 1, a receptacle opening 20 for the pin 19 is located in the lower part 2, in the region of the moulding 13, downstream of the activation end having the formed element 17 of the set screw 14. The pin 19 per se in the initial state, prior to and during calibration, is located in the lid 18 of the housing. To this end, a portion of a closure duct 21 is formed on the lid 18 in the lid 18 (cf. FIG. 4). The receptacle opening 20 in the lower part is located in a portion of the closure duct on the lower part. The pin 19 is attached to the portion of the closure duct 21 on the lid. The portion of the closure duct 21 on the lid is open both towards the inside, towards the lower part 2 having the portion of the closure duct on the lower part, as well as towards the outside, towards the housing external side 23. In the exemplary embodiment shown in FIG. 4, the pin 19 together with the lid has been conjointly moulded in an injection-moulding procedure. The pin 19 has a pin head 24 that points towards the external side 24. Said pin head 24 is moulded to the internal wall of the portion of the closure duct 21 on the lid, so as to be separable from said internal wall. To this end, thin retaining webs 22 which in the initial position retain the pin 19 on the internal wall of the portion of the closure duct 21 on the lid. In order for the pin 19 to be slid in front of the set screw 14, pressure is exerted in an inward manner from the outside by way of a tool, for example a ram, on the head 24 of the pin 19. The retaining webs 22 are torn off once a sufficiently high force has been reached and the pin 19 is severed from the internal wall of the portion of the closure duct 21 on the lid. Said pin 19 can then be pushed and displaced into the portion of the closure duct on the lower part, so as to be in front of the set screw, and into the receptacle opening 20. The pin 19 in the initial position is thus attached so as to be displaceable in the lid. Once the pin 19 has been severed and displaced in front of the set screw 14, the latter can no longer be activated from the outside.

In the embodiment illustrated, the displacement of the closure element, presently of the pin 19, is performed by gliding laterally along the closure duct. In a further embodiment (not illustrated in the figures here), the pin can also be configured as a threaded pin and by way of rotation can be screwed into a counter thread that is located on the internal wall of the closure duct until said pin comes to lie in front of the set screw. In this embodiment, the head of the pin 19 has a formed element for contacting in a form-fitting manner a tool for the rotating activation of the pin 19, for example a Phillips recessed head contour or a Torx contour, or a hexagonal contour, or the like.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

| | |
|---|---|
| 1 | Circuit breaker |
| 2 | Lower part |
| 3 | Terminal connection |
| 4 | Thermal release |
| 5 | Arc guide rail |
| 6 | Narrow side |
| 7 | Exhaust air opening |
| 8 | Wall element |
| 9 | Wall piece |
| 10 | Wall piece |
| 11 | Fastening side |
| 12 | Portion of the exhaust air duct |
| 13 | Moulding |
| 14 | Set screw |
| 15 | Threaded portion |
| 16 | Pin portion |
| 17 | Formed element |
| 18 | Lid |
| 19 | Pin |
| 20 | Receptacle opening |
| 21 | Closure duct |
| 22 | Retaining web |
| 23 | Housing external side |
| 24 | Pin head |

What is claimed is:

1. An installation switching apparatus comprising:

a housing;

at least one contact point;

an exhaust air duct which in an upstream portion thereof is configured to receive arc gases of a switching arc that has been created at the at least one contact point, and by way of an exhaust air opening in a housing wall of the housing in a downstream portion of the exhaust air duct the exhaust air duct is configured to release the arc gases into an environment of the housing;

at least one thermal release; and a set screw configured to set the at least one thermal release, wherein the set screw at an activation end thereof has a formed element configured to contact in a form-fitting manner a tool configured for rotating activation of the set screw, wherein an operative end of the set screw is coupled to the at least one thermal release, and wherein the activation end of the set screw is located in the downstream portion of the exhaust air duct and is accessible through the exhaust air opening for activation by the tool.

2. The installation switching apparatus according to claim 1, wherein a counter thread on a housing side for the set screw is located in a housing moulding on a housing internal side.

3. The installation switching apparatus according to claim 1, wherein the housing has a closure duct that is located downstream of the activation end, a screw cover part being displaceably attached in the closure duct, and wherein the screw cover part in the closure duct under an effect of an activation force is configured so as to be displaceable in front of the activation end of the set screw in order for the latter to be covered.

4. The installation switching apparatus according to claim 3, wherein the housing has a lower part and a lid, and wherein the screw cover part comprises a pin which, in an initial position, is retained in a portion of the closure duct on the lid by retaining webs, is moulded to the internal wall of the portion of the closure duct on the lid.

5. The installation switching apparatus according to claim 4, wherein the pin, for covering the set screw, is separable from the retaining webs and is displaceable from the portion of the closure duct on the lid to a portion of the closure duct on the lower part of the housing.

* * * * *